US006339384B1

(12) United States Patent
Valdes-Rodriguez

(10) Patent No.: US 6,339,384 B1
(45) Date of Patent: Jan. 15, 2002

(54) TOLL BOOTH CREDIT DEVICE

(76) Inventor: Robert Valdes-Rodriguez, 218 E. 29th St., Apt. 7, New York, NY (US) 11729

( * ) Notice: Subject to any disclaimer, the term of this patent is extended or adjusted under 35 U.S.C. 154(b) by 0 days.

(21) Appl. No.: 09/710,930

(22) Filed: Nov. 13, 2000

(51) Int. Cl.[7] ..... G08G 1/00
(52) U.S. Cl. ..... 340/928; 340/933; 235/384
(58) Field of Search ..... 340/928, 933, 340/5.21, 5.23, 10.3, 825.69; 235/382, 383, 384

(56) References Cited

U.S. PATENT DOCUMENTS

| | | | | |
|---|---|---|---|---|
| 4,001,696 A | | 1/1977 | Bannerman | 455/144 |
| 4,390,880 A | * | 6/1983 | Henoch | 342/50 |
| 5,204,675 A | | 4/1993 | Sekine | 340/933 |
| 5,552,789 A | | 9/1996 | Schuermann | 340/5.21 |
| 5,955,970 A | | 9/1999 | Ando et al. | 340/928 |
| 5,969,641 A | | 10/1999 | Nakamura et al. | 340/928 |
| 6,018,641 A | | 1/2000 | Tsubouchi et al. | 340/10.3 |
| 6,019,285 A | | 2/2000 | Isobe et al. | 235/384 |
| 6,049,289 A | | 4/2000 | Waggamon et al. | 340/5.23 |
| 6,091,343 A | | 7/2000 | Dykema et al. | 340/825.69 |
| 6,263,316 B1 | * | 7/2001 | Khan et al. | 235/384 |

* cited by examiner

*Primary Examiner*—Van T. Trieu
(74) *Attorney, Agent, or Firm*—Michael I Kroll

(57) ABSTRACT

A device for automatically paying a toll for a vehicle passing through a toll booth. The toll payment device includes a transmitting device and a switch. The transmitting device includes a receiver for receiving a signal from an antenna at the toll booth; a memory unit for storing identification information associated with the device; and a transmitter connected to both the receiver and memory unit for transmitting a signal including the stored identification information to the antenna upon receipt of the signal and allowing the antenna to charge an account associated with the device. The switch selectively disconnects the memory unit from the transmitter thereby preventing transmission of the identification information to the antenna and charging of the account associated with the device. The switch includes a first switch positioned adjacent a driver seat of the vehicle and a second normally closed switch connected between the memory unit and transmitter, wherein activation of the first switch toggles the second switch into an open position thereby disconnecting the memory unit and transmitter. The switch also includes a visual indicator for informing the user when the signal transmitted by the user's has been recorded by the device. The visual indicator can also provide an indication when the user's account is overdrawn and needs to be replenished. The transmitting device is preferably positioned in a hidden location such as under a hood of the vehicle, within a compartment inside the vehicle or within a rear view mirror of the vehicle.

21 Claims, 6 Drawing Sheets

TOLL BOOTH CREDIT DEVICE

BACKGROUND OF THE INVENTION

1. Field of the Invention

The present invention relates generally to toll payment devices and, more specifically, to a device able to be positioned within a vehicle and hidden from sight for automatically paying a toll as the vehicle passes through a toll booth, the device being able to record the transmitted signal transmitted by a presently in use toll payment tag and transmitting the signal to a toll collection device upon passing through a toll booth.

2. Description of the Prior Art

Numerous types of toll booth pass cards have been provided in the prior art. An example of such a system is the E-Z Pass® System being used along the east coast of the United States. FIG. 1 illustrates a toll booth 10 utilizing such a system. As can be seen from this figure, a vehicle 12 is passing through the toll booth 10. The vehicle 12 has an E-Z Pass® tag 14 positioned in the windshield 15 of the vehicle 12. As the vehicle 12 passes through the toll booth 10, an antenna 16 is triggered to transmit a signal to the E-Z Pass® tag 14. The signal transmitted by the antenna 16 is indicated by the arrow labeled with the numeral 18. Upon receipt of the signal 18, the E-Z Pass® tag 14 transmits a signal including a tag identification number. The signal transmitted by the E-Z Pass® tag 14 is indicated by the arrow labeled with the numeral 20. The toll is charged to the account identified by the tag identification information and the tag identification information is recorded and a display 22 is controlled to indicate that the toll was paid upon receipt of the signal 20 by the antenna 16. The antenna 16 may also control a series of lights 17 for providing an additional indication as to payment of the toll. Certain problems with this system is that the tag is large and therefore may obstruct or distract the driver when positioned in the windshield 15. The tag is also unattractive and distracts from the style of the vehicle. Furthermore, the tag is positioned in a highly visible location and thus is readily seen by thieves who may look to steal the tag.

U.S. Pat. Nos. 4,001,696; 5,204,675; 5,552,789; 5,955,970; 5,969,641; 6,018,641; 6,019,285; 6,049,289 and 6,091,343 are also illustrative of such prior art. While these units may be suitable for the particular purpose to which they address, they would not be as suitable for the purposes of the present invention as heretofore described.

U.S. Pat. No. 4,001,696

Inventor: George Louis Bannerman

Issued: Jan. 4, 1977

An electronic antenna adapted for concealment in an automobile or similar vehicle is tuned by the RF tuning circuits of a conventional radio receiver. In the preferred embodiment, the antenna is designed for the AM and FM broadcast bands and includes a concealed metal plate which may be suitably mounted at a convenient location on the vehicle such as being embedded in the crash panel. RF signals are received by the metal plate pick-up which is connected to both low frequency and high frequency RF amplifiers which amplify them and, after suitable filtering, provide a highly selective output to the conventional radio receiver. This is due to the fact that when the conventional radio receiver is tuned to a station, it presents a very high impedance load at that frequency thereby causing the low frequency RF amplifier of the electronic antenna to amplify that frequency in preference to all others.

U.S. Pat. No. 5,04,675

Inventor: Hiroyoshi Sekine

Issued: Apr. 20, 1993

A System for collecting a toll for a vehicle, on which a vehicle number plate is mounted, is disclosed. In the system, a radio card as a storage medium is provided in the vehicle. The radio card generates a data signal representing identification data including a vehicle number data. A radio card access system receives the data signal transmitted from the radio card and processes the data signal to obtain the vehicle number data contained in the radio card. A TV camera picks up an image corresponding to a vehicle number from the number plate of the vehicle. The radio card access system generates vehicle number plate data from the image picked up by the TV camera. The radio card access system compares the vehicle number data and vehicle number plate data and verifies whether or not the two sets of data coincide, the toll of the vehicle is calculated in accordance with the identification data stored in the storage medium.

U.S. Pat. No. 5,552,789

Inventor: Josef H. Schuermann

Issued: Sep. 3, 1996

An integrated vehicle communications system for on-board use within a vehicle which may also communicate with external portions of the system which includes miniaturized, self-contained read/write transponders 20, 22, 30 of the type disclosed in Schuermann U.S. Pat. No. 5,053,774, for providing functions within the vehicle, e.g., for sensing conditions and parameters. The on-board interrogation unit 10 interrogates and receives signals by RF communication provided by on-board antennas 14, 26, 28 between the interrogation unit and respective transponders for read/write responder operation. The processor 33 with display device 34*a* and/or control circuits 34*b* carries out on-board functions in response to such interrogation. A transponder 22 may serve as a vehicle operator key by which the system may verify key code, unlock the vehicle doors, as well as select and perform initialization functions including ignition, seat and seat belt adjustment, mirror positioning, and antitheft functions before vehicle entry by the operator. A transponder 30 may access external control data for premises or toll access, and may provide toll or credit or service transactions, as for authorization or verification or toll charge debiting purposes. The system may include also IR links.

U.S. Pat. No. 5,955,970

Inventor: Masamiki Ando et al.

Issue Sep. 21, 1999

In a toll gate system in which the toll is automatically and electronically collected through wireless communication between an on-board electronic device and a stationary electronic device installed at the toll gate, illegitimate or fraudulent actions committed in the system are detected by the on-board device. When such actions are detected, a communication function of the on-board device is made inoperative. After disposing the illegitimate actions properly, the communication function of the on-board device is restored so that the on-board device can be used again thereafter. The illegitimate action such as opening the on-board device for changing or reading the data contained therein can be detected by sensing removal of screws fastening a circuit board to a case of the on-boar device.

U.S. Pat. No. 5,969,641

Inventor: Yuki Nakamura et al.

Issued: Oct. 19, 1999

A plurality of antennas receives radio wave transmitted from a vehicle which comes in a toll collection area. Each antenna has at least three antenna elements, and the antennas are disposed in the horizontal direction and vertical direction. The signal analyzer analyzes the ID signal included in the received radio wave to identify the vehicle. The direction detector measures the direction of arrival (DOA) of radio wave received by two antennas selected by the antenna selector by way of two-dimensional interferometry principle in terms of the directional angle and depression angle. The location detector calculates the location of the vehicle in the horizontal direction and the height in the vertical direction of the vehicle as a location information based on the DOA of the radio wave measured by the direction detector. The vehicle tracking unit generates the locus data of the vehicle based on the location information calculated by the location detector and the information for identifying the vehicle analyzed by the signal analyzer. On the other hand, the video camera takes a picture of the vehicle which comes in the toll collection area to obtain the picture data. The data correlation unit judges whether the vehicle is a violator vehicle by correlating the picture data and locus data. The controller registers the locus data and picture data of the vehicle if the vehicle is a violator vehicle. On the other hand, the controller collects a prescribed toll from the vehicle if the vehicle is not a violator vehicle.

U.S. Pat. No. 6,018,641

Inventor: Kazuo Tsubouchi et al.

Issued: Jan. 25, 2000

A radio IC card system includes an IC and a toll collector. When an automobile with the IC card passes by a tollgate, the toll collector installed in the tollgate transmits a first radio signal which is spread modulated using a pseudorandom noise (PN) code from an antenna. The first radio signal is received by the antenna of the IC card and is transmitted to a surface acoustic wave (SAW) correlator. The SAW correlator extracts a PN code included in the received signal, and outputs a peak signal. An accumulation circuit accumulates the peak signal. A threshold discharger is activated to switch on a relay switch when the output voltage of the accumulation circuit exceeds a constant value. Thereby, the voltage of a battery is supplied to a data communication unit. Then, the identification code of the IC and a record of tollgates by which card the automobile has passed are transmitted via radio signal to the toll collector.

U.S. Pat No. 6,019,285

Inventor: Norihiro Isobe et al.

Issued: Feb. 1, 2000

An automatic toll charging system communicates by radio between roadside units disposed on each gate of a toll road and a vehicle-mounted unit mounted in a vehicle, and automatically charges a toll in a range from an entrance gate to an exit gate. In this system, an IC card is inserted in the vehicle-mounted unit,and payment information recorded in the IC card and entrance information received from a roadside unit, disposed at the entrance gate are recorded in the information recording part of the vehicle-mounted unit. In addition, the entrance information recorded in the information recording part is transmitted to the roadside unit disposed at the exit gate, and a toll payment process is executed. The entrance information is recorded in the IC card as a backup so the toll payment process can be executed even if a function of the vehicle-mounted unit is performed improperly.

U.S. Pat. No. 6,049,289

Inventor: Dennis W. Weggamon et al.

Issued: Apr. 11, 2000

A remote control system for opening and closing a barrier, such as a garage door, includes an RF receiver and a plurality of RF transmitters. The transmitters and receiver include circuitry programmed to provide transmission of encrypted code signals each time the transmitters are used and employing a code hopping method which prevents unauthorized signal interception or code "grabbing". The system is operated in a code learning mode for the receiver by momentarily actuating a receiver learn mode button for receiving each transmitter identification code and a secret decryption key for that transmitter with the system automatically returning to the operate mode. Each transmitter identification and secret key code signal is automatically and randomly stored in an available and unused memory in the receiver circuitry. A multibit hopping code is transmitted from each transmitter to the receiver with each transmitter operation in the operate mode of the system and the hopping code changes with each transmission to prevent theft or code grabbing and resultant unauthorized operation of the system.

U.S. Pat No. 6,091,343

Inventor: Kurt A. Dykema et al.

Issued: Jul. 18, 2000

A trainable transmitter is described that is capable of learning and replicating both AM and FM signals. The trainable transmitter also has the capacity to learn and replicate RF signals in both the 27 MHz to 40 MHz and the 250 MHz to 450 MHz frequency bands commonly used in European garage door openers. The trainable transmitter allows an individual to input an identification of the country in which the trainable transmitter will be operated such that the trainable transmitter may then transmit the learned signals at the maximum level permitted for the identified county.

SUMMARY OF THE PRESENT INVENTION

The present invention relates generally to toll payment devices and, more specifically, to a device able to be positioned within a vehicle and hidden from sight for automatically paying a toll as the vehicle passes through a toll booth, the device being able to record the transmitted signal transmitted by a presently in use toll payment tag and transmitting the signal to a toll collection device upon passing through a toll booth.

A primary object of the present invention is to provide a toll payment device that will overcome the shortcomings of prior art devices.

Another object of the present invention is to provide a toll payment device which is able to be positioned within a vehicle and hidden from sight so as not to obstruct the view of the driver or be readily visible to thieves.

A further object of the present invention is to provide a toll payment device including a switch positioned so as not to obstruct the movement or vision of the driver for reading the signal from a toll payment tag.

A still further object of the present invention is to provide a toll payment device wherein the switch includes a visual indicator for informing the user when the signal from the toll payment tag has been recorded.

A yet further object of the present invention is to provide a toll payment device which is integrally connected within a vehicle and thus cannot be stolen.

A still further object of the present invention is to provide a toll payment device positioned within a specially designed compartment or within the rear view mirror of the vehicle.

An even further object of the present invention is to provide a toll payment device wherein the switch is located on the dashboard or rearview mirror.

A yet further object of the present invention is to provide a toll payment device which allows the toll payment tag to be removed a window of the vehicle and thus improves the vision of the driver and removing an unattractive tag from view.

A still further object of the present invention is to provide a toll payment device which allows use of a single toll payment tag in numerous vehicles without the need for transferring the toll payment tag between the vehicles.

An even further object of the present invention is to provide a toll payment device which can be preprogrammed with a user's toll payment tag information by a vehicle dealer prior to the user picking up the vehicle.

Another object of the present invention is to provide a toll tag recording device that simplifies use of presently and widely accepted toll payment tags.

A still further object of the present invention is to provide a toll payment device that utilizes and improves present toll payment systems by preventing theft of toll payment tags and removes the need to position unattractive toll payment tags on a window of the vehicle.

Additional objects of the present invention will appear as the description proceeds.

A device for automatically paying a toll for a vehicle passing through a toll booth is disclosed by the present invention. The toll payment device includes a transmitting device and a switch. The transmitting device includes a receiver for receiving a signal from an antenna at the toll booth; a memory unit for storing identification information associated with the device; and a transmitter connected to both the receiver and memory unit for transmitting a signal including the stored identification information to the antenna upon receipt of the signal and allowing the antenna to charge an account associated with the device. The switch selectively disconnects the memory unit from the transmitter thereby preventing transmission of the identification information to the antenna and charging of the account associated with the device. The switch includes a first switch positioned adjacent a driver seat of the vehicle and a second normally closed switch connected between the memory unit and transmitter, wherein activation of the first switch toggles the second switch into an open position thereby disconnecting the memory unit and transmitter. The switch also includes a visual indicator for informing the user when the signal transmitted by the user's has been recorded by the device. The visual indicator can also provide an indication when the user's account is overdrawn and needs to be replenished. The transmitting device is preferably positioned in a hidden location such as under a hood of the vehicle, within a compartment inside the vehicle or within a rear view mirror of the vehicle.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference character designate the same or similar parts throughout the several views.

DESCRIPTION OF THE REFERENCED NUMERALS

Figure 1:
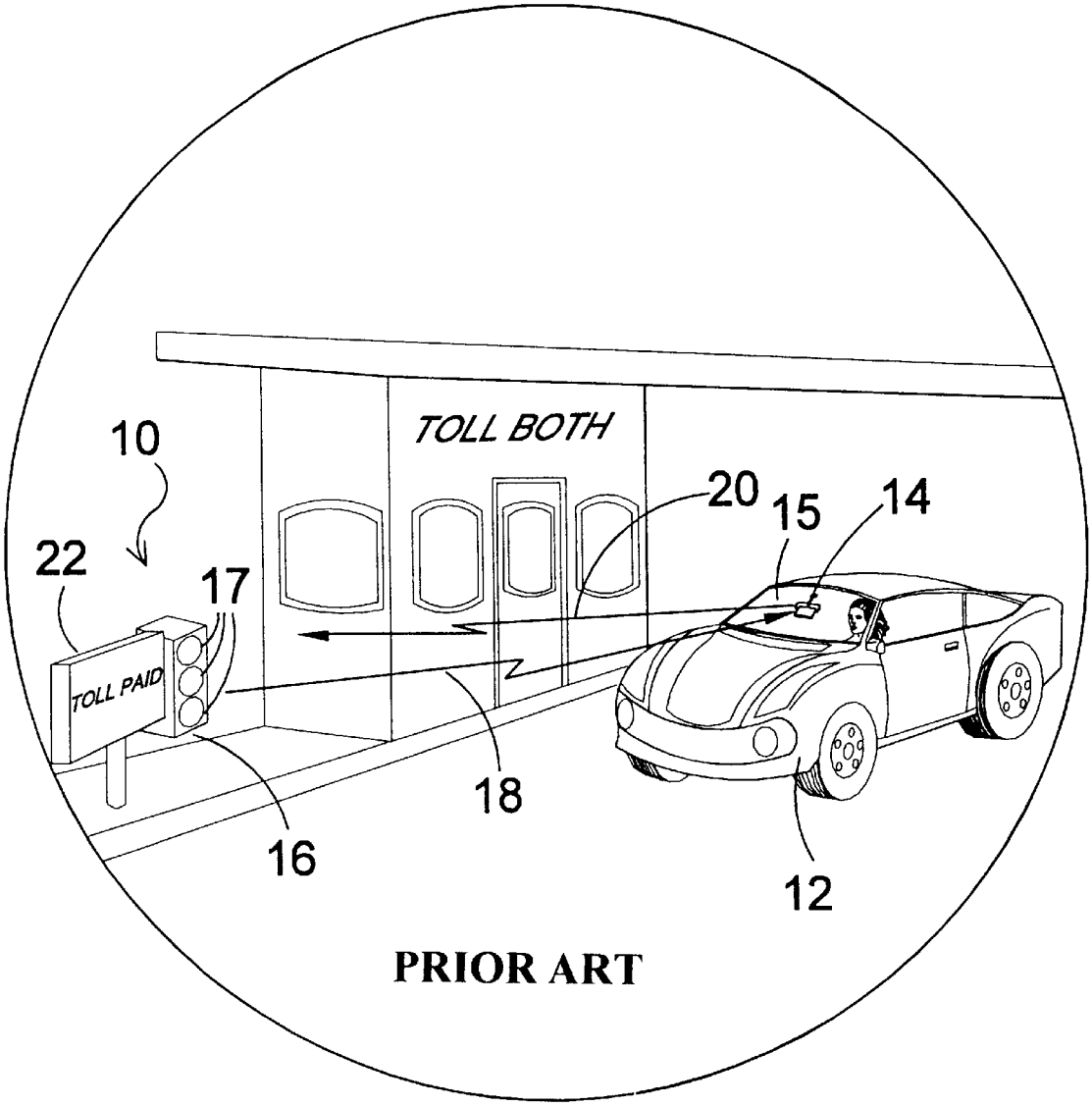
FIG. 1 is a perspective view of a vehicle paying a toll automatically using the conventionally known system.

Turning now descriptively to the drawings, in which similar reference characters denote similar elements throughout the several views, the Figures illustrate the toll payment device of the present invention. With regard to the reference numerals used, the following numbering is used throughout the various drawing figures.

10 conventional toll booth
12 vehicle
14 conventional automatic toll paying device
15 windshield of vehicle
16 antenna
17 series of toll payment indicator lights on antenna
18 signal transmitted by antenna to vehicle passing through toll booth
20 signal transmitted by toll paying device in response to receipt of signal from antenna
22 display indicating toll was paid
24 signal transmitted by toll payment device of the present invention in response to receipt of signal from antenna
26 cabin of vehicle
28 compartment within cabin of vehicle
30 toll payment device of present invention

31 first visual indicator
32 transmission device
33 second visual indicator
34 switch for deactivating toll payment device
36 lid selectively covering compartment
38 driver of vehicle
40 hood of vehicle
42 wire connecting switch and transmission device
44 transmitter
46 receiver
48 power source
50 memory
52 second normally closed switch between memory and transmitter
54 arm of second switch
54 transmitter

DETAILED DESCRIPTION OF THE PREFERRED EMBODIMENT

Turning now descriptively to the drawings, in which similar reference characters denote similar elements throughout the several views, FIGS. 2 through 6 illustrate the toll payment device of the present invention indicated generally by the numeral 30.

Figure 2:
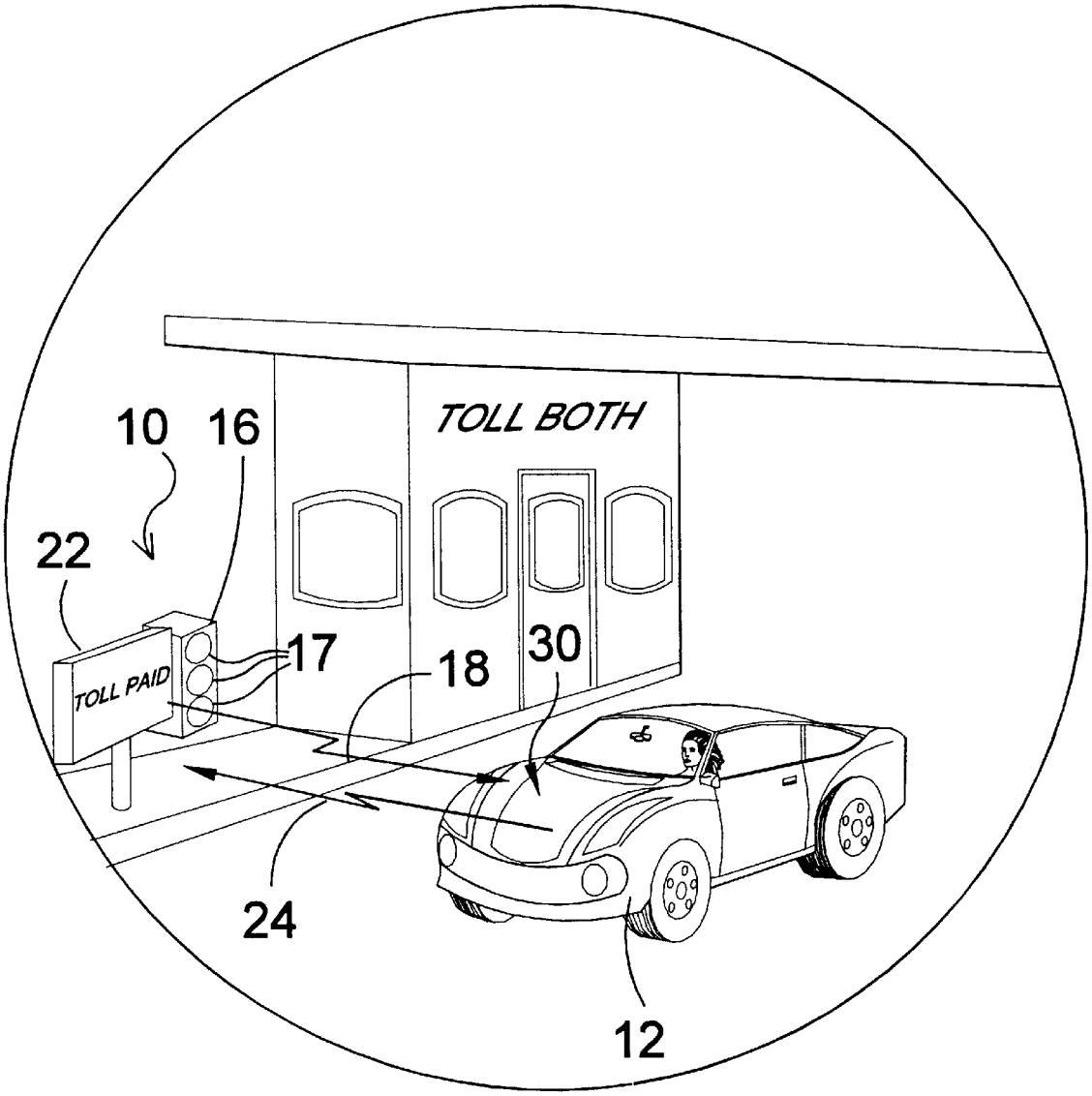
FIG. 2 is perspective view of a vehicle including the toll payment device of the present invention positioned therein for use in paying a toll.

The toll payment device 30 of the present invention is shown in FIG. 2. This figure illustrates a toll booth 10 with a vehicle 12 having the toll payment device 30 of the present invention installed therein. The toll payment device 30 is installed in a non-visible position and thus neither obstructs the view of the driver nor is able to be seen by potential thieves. The toll payment device 30 is able to record the signal transmitted by the user's toll payment tag and transmit the recorded signal upon passage through the toll booth 10. As the vehicle 12 passes through the toll booth 10, the antenna 16 is triggered to transmit the signal 18. This signal is received by the toll payment device 30 and in response thereto the recorded signal including the tag identification information recorded from the toll payment tag is transmitted back to the antenna 16. The signal transmitted by the toll payment device 30 is indicated by the arrow labeled with the numeral 24. Upon receipt of the signal 24 by the antenna 16, the display 22 is controlled to indicate that the toll was charged to the account represented by the tag identification information.

Figure 3:
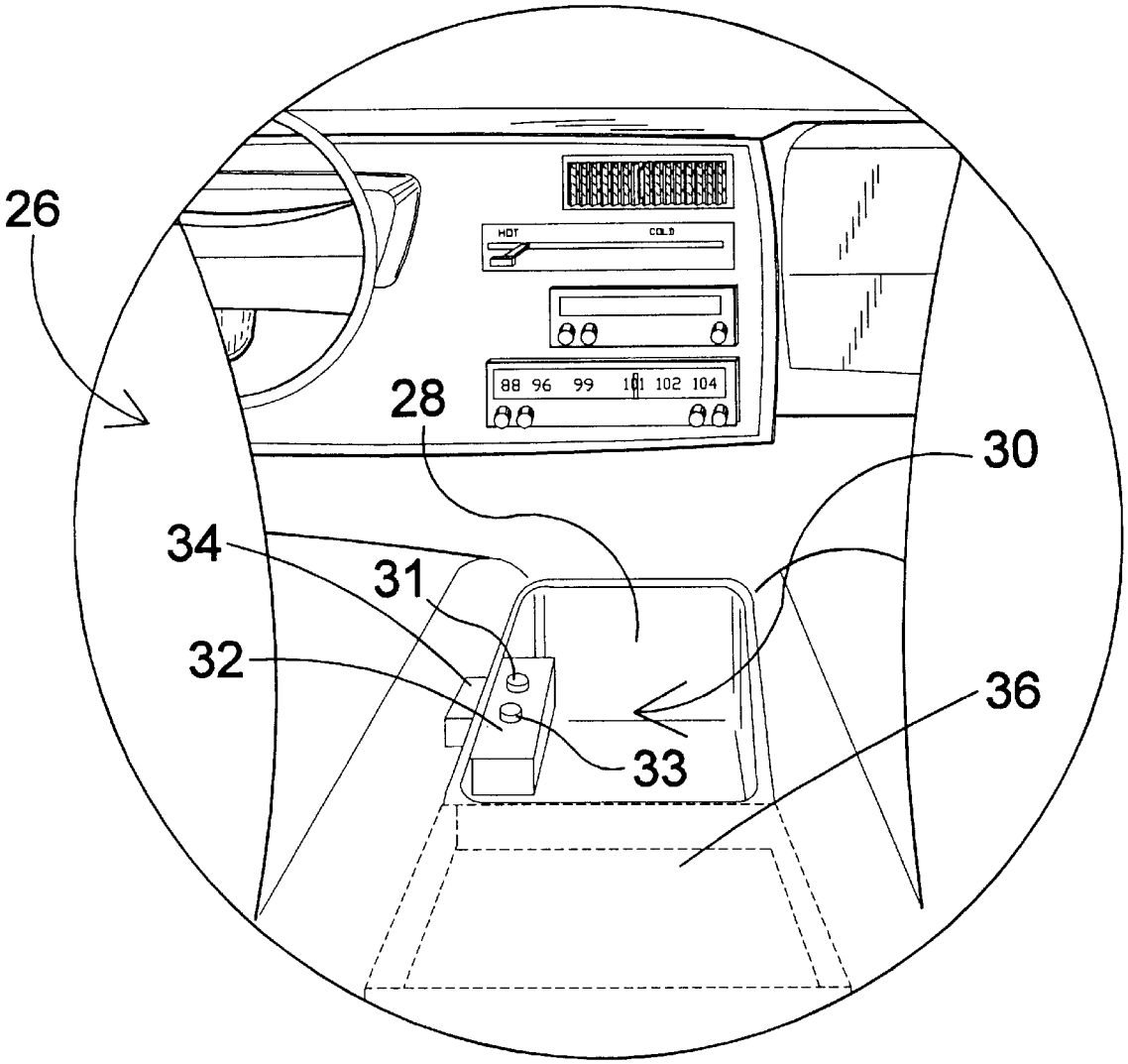
FIG. 3 is a perspective view of an inside cabin of a vehicle including the toll payment device of the present invention positioned within a compartment therein.

FIG. 3 illustrates a cabin 26 within the vehicle 12. Within the cabin 26 is a compartment 28 in which the toll payment device 30 is positioned. The toll payment device 30 includes a transmission device 32 and a manually operated switch 34 connected thereto. The transmission device 32 is positioned within the compartment 28 and the switch 34 is positioned on an outer side of the compartment 28. The switch 34 is positioned so as to be readily activated by a driver of the vehicle 12. The compartment 28 includes a cover 36 for selectively sealing the compartment 28 and thereby hiding the transmission device 32 of the toll payment device 30. The switch 34 is able to be toggled into a first connected position for normal operation of the toll payment device 30, to a second position for reading and recording a signal from a toll payment tag and a third position for disconnecting the memory storing the recorded signal from the transmitter thereby preventing a toll from being charged to the user's account upon passage through a toll booth 10. A first visual indicator 31 is positioned on the transmission device 32 for indicating when the signal from the toll payment tag has been recorded. The first visual indicator is preferably a green light emitting diode (LED). A second visual indicator 33 for indicating when recording of the signal from the toll payment tag has not been accomplished. The second visual indicator 33 is also able to alert the user when the account for the toll payment device is overdrawn. The second visual indicator is preferably a red light emitting diode (LED).

Figure 4:
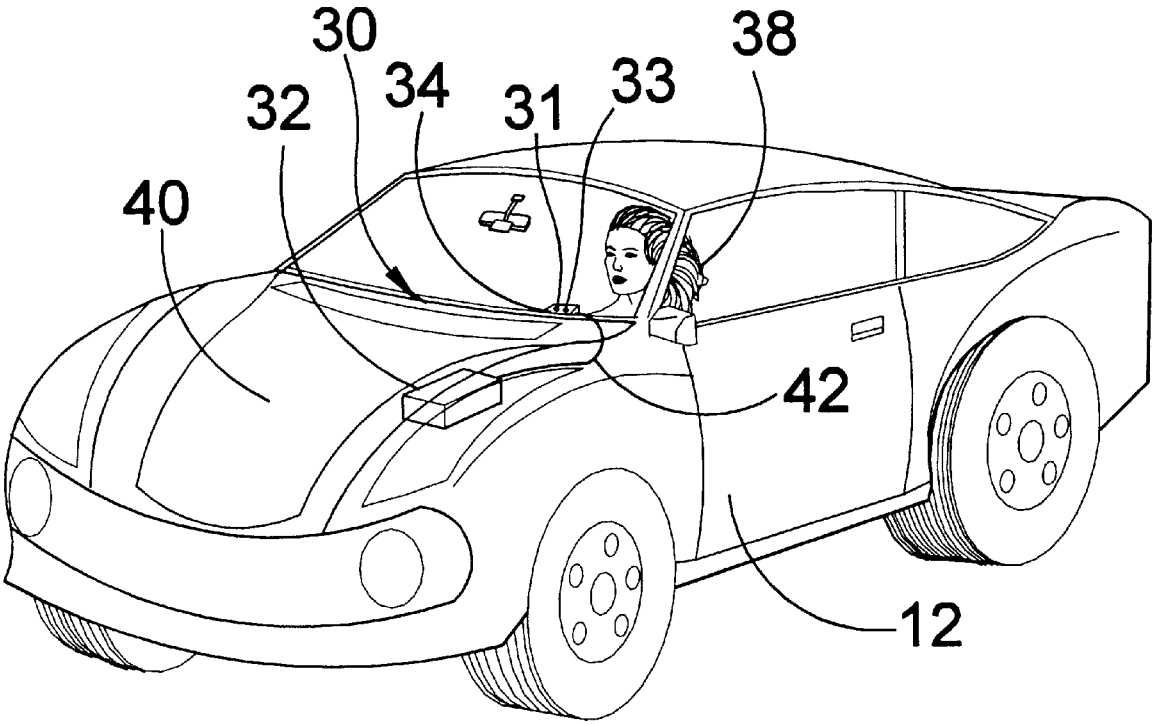
FIG. 4 is a perspective view of a vehicle including the toll payment device of the present invention positioned under the vehicle hood.

An alternative position for the transmission device 32 of the toll payment device 30 is shown in FIG. 4. FIG. 4 shows the transmission device 32 in a position similar to that of FIG. 2, under the hood 40 of the vehicle 12. The switch 34 is positioned adjacent a driver 38 of the vehicle 12 and thus can be readily activated by the driver 38 of the vehicle 12. The switch 34 is connected to the transmission device 32 by a connection wire 42 extending from the transmission device 32 and into the vehicle 12 to the switch 34. The first and second visual indicators 31 and 33 are positioned adjacent the switch 34 and can be easily viewed by the driver 38. The first and second visual indicators 31 and 33 are also connected to the transmission device 32 via the connection wire 42. The transmission device 32 is preferably positioned so as to be able to readily receive the signal 18 transmitted by the antenna 16 as the vehicle 12 passes through the toll booth 10. An example of a suitable position for the transmission device 32 is against the front grill of the vehicle 12 so that the signal may be received through the grill plate of the vehicle 12. Activation of the switch 34 will deactivate the transmission device 32 and thus prevent the transmission of the signal 24 tot he antenna 16. In such an instant, the driver 38 will have to pay the toll manually. This switch 34 is beneficial when the driver 38 is not the owner of the vehicle 12 and does not wan the owner to be charged for the toll.

Figure 5:
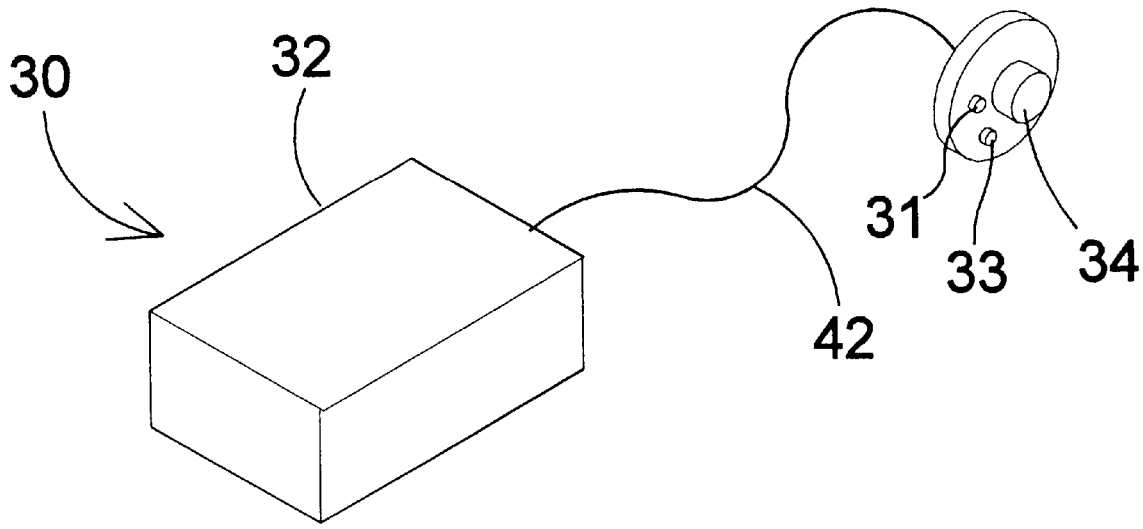
FIG. 5 is a top perspective view of the toll payment device of the present invention.

An enlarged view of the toll payment device 30 of the present invention is illustrated in FIG. 5. As can be seen from this figure, the toll payment device 30 includes the transmission device 32 and the switch 34. The connection wire 42 connects the switch 34 to the transmission device 32. The switch 34 is a manually activated three position switch 34 and is utilized to deactivate the transmission device 32 to prevent the paying of a toll thereby, for enabling recording of the signal from a toll payment tag and placing the toll payment device in an operating position for paying tolls upon passage through a toll booth. Placement of the switch 34 in the first position is useful when driving a vehicle belonging to another person or in any other instance when it is not desired to have the toll charged to the account represented by the toll payment device 30. The first and second visual indicators 31 and 33 are positioned adjacent the switch 34 and can be easily viewed by the driver 38. The first and second visual indicators 31 and 33 are also connected to the transmission device 32 via the connection wire 42. The first visual indicator 31 indicates, during recording of the signal from a toll payment tag, that the signal has been recorded successfully and, during operation of the toll payment device 30, that the toll payment device is operating properly. The second visual indicator 33 is illuminated to indicate that the toll payment device 30 is in a bypass position in which a toll will not be paid, when the signal has not been recorded properly and when a user's toll payment account is overdrawn and must be replenished.

Figure 6:
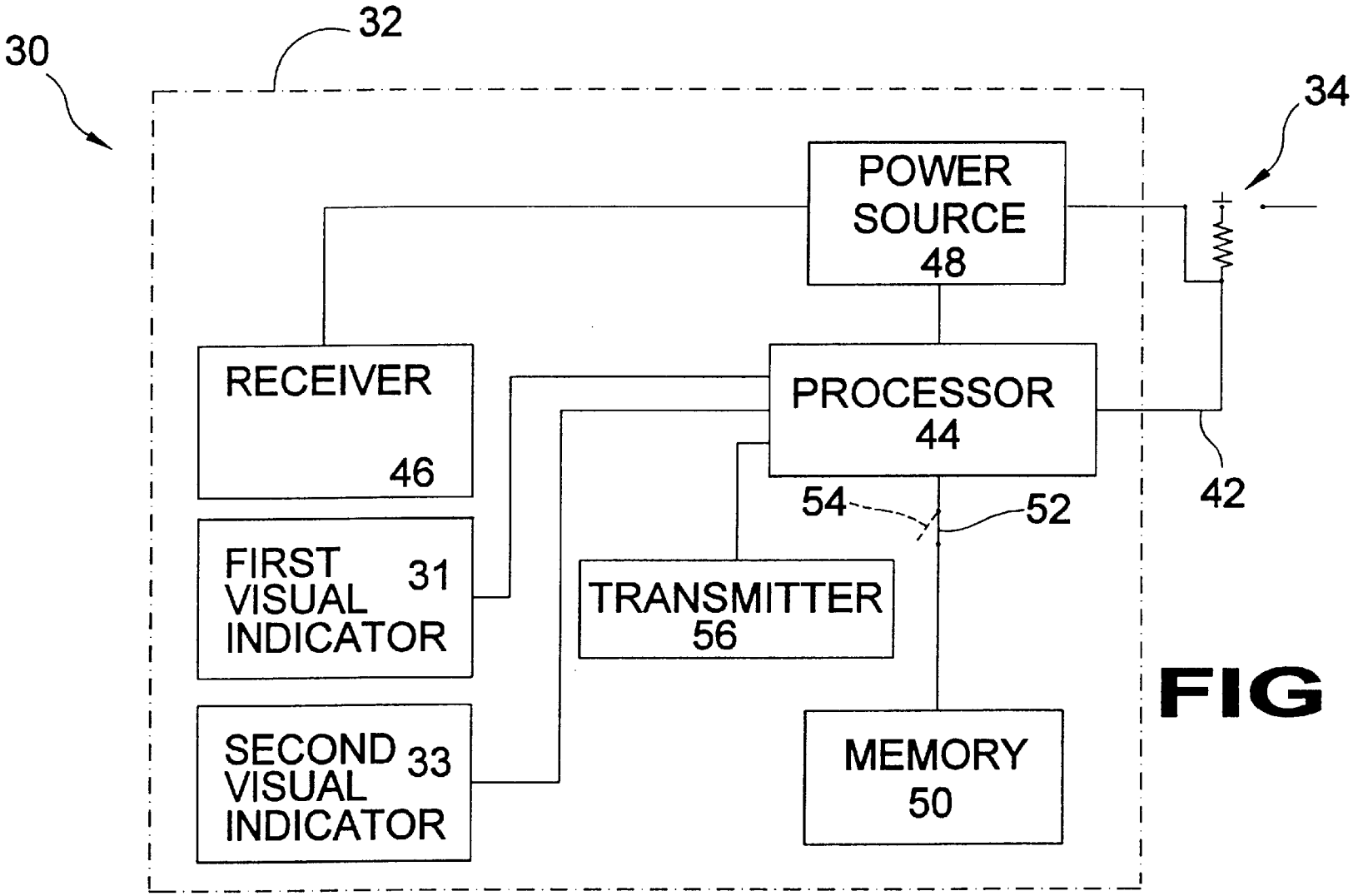
FIG. 6 is block diagram of the toll payment device of the present invention.

A block diagram illustrating the toll payment device 30 is shown in FIG. 6. As can be seen from this figure, the transmission device 32 includes a processor 44 for controlling operation of the transmission device 32. Connected to the processor 44 is a transmitter 56, a receiver 46 and a memory unit 50. The receiver 46 receives the signal transmitted by the antenna 16 within the toll booth 10. Upon receipt of this signal the receiver 46 signals the processor 44 to retrieve the recorded signal from the memory unit 50. The processor 44 then triggers the transmitter 44 to transmit the retrieved signal to the toll booth antenna. The processor 44 and receiver 46 are both connected to an internal power supply 48. Alternatively, the power supply 48 can be the vehicle battery and the transmitting device 32 can thus be powered by the vehicle battery. The memory unit 50 is connected to the transmitter 44 for supplying the tag identification information thereto for transmission. The tag identification information is transmitted by the transmitter 44 upon receipt of a trigger signal from the receiver 46. A second switch 52 is connected between the processor 44 and the memory unit 50. The three position switch 34 is connected between the power source 48 and the transmitter 44. When the switch 34 is toggled into the first position, a voltage is removed from application to the processor 44. Removal of this voltage to the processor 44 causes the processor 44 to toggle the arm 54 of the second switch 52 into the open position. The second switch 52 is a normally closed switch thereby normally connecting the memory unit 50 to the transmitter 44. When the switch 34 is toggled into the first position, a voltage is applied to the toggle arm 54 of the second switch 52 causing it to move into the open position thereby disconnecting the memory unit 50 and the processor 44. The processor 44 is thus unable to retrieve the tag identification information from the memory unit 50 and thus cannot transmit this information back to the antenna 16 of the toll booth 10. Thus the account associated with the toll payment device 30 is not charged and the driver must pay the toll manually. The processor 44 will retain the second switch 52 in the open position for a predetermined period of time thereby disconnecting the memory unit 50 and the transmitter 44 for a time period able to allow the vehicle to pass through the toll booth without activating the antenna to charge the account memory unit 50 and the transmitter 44. At this time the second visual indicator 33 is illuminated to indicate to the driver that the switch 34 is in the first position. After the predetermined time period the switch 34 will return to the open position thereby preventing the application of voltage to the second switch 54 and returning the toll payment device 30 to its normal position and ready for passage through subsequent toll booths. When the first switch 34 is in the second position, a predetermined voltage is applied to the processor 44. In response to receipt of this voltage, the processor 44 causes the transmitter 56 to transmit a signal similar to the signal transmitted by the antenna at a toll booth. This signal causes the toll payment tag to transmit a response signal including identification information to the receiver 46. This information is recorded in the memory unit 50 by the processor 44. Upon completion of recording in the memory unit 50, the first indicator light 31 is illuminated. If the memory unit 50 did not property record the signal from the toll payment tag, the second indicator light 33 will become illuminated. When the switch 34 is placed in the third position, the toll payment device 30 will operate normally and the first indicator light 31 will be illuminated.

The operation of the toll payment device 30 will now be described with reference to the figures. In operation, the transmitting device 32 of the toll payment device 30 is first installed within a vehicle 12 so as to be hidden from view. The switch 34 is connected between the transmitting device 32 and the power source 48. The switch 34 is positioned adjacent the drivers seat of the vehicle and thus can be readily activated by the driver. Once installed, the toll payment device 30 must be set up to record the identification information of a toll payment tag of the user. The identification information is included in a signal which is transmitted by the toll payment tag upon passing through a toll booth. In order to record this information, the switch 34 is placed in the second position. When the first switch 34 is in the second position, a predetermined voltage is applied by the power source 48 to the processor 44. In response to receipt of this voltage, the processor 44 causes the transmitter 56 to transmit a signal similar to the signal transmitted by the antenna at a toll booth. This signal causes the toll payment tag to transmit a response signal including identification information to the receiver 46. This information is recorded in the memory unit 50 by the processor 44. Upon completion of recording in the memory unit 50, the first indicator light 31 is illuminated. If the memory unit 50 did not properly record the signal from the toll payment tag, the second indicator light 33 will become illuminated. At this point the toll payment device 30 is ready for operation.

As a vehicle 12 is riding along a highway it frequently encounters a toll booth on a toll road. At the approach of a toll booth 10, the vehicle 12 passes over a switching device on the ground in front of the toll lane to trigger a toll payment system. Upon triggering the toll payment system, an antenna 16 is caused to transmit a signal to the transmitting device 32 of the vehicle 12. The receiver 46 within the transmitting device 32 receives the signal transmitted by the antenna 16. Upon receipt of this signal the receiver triggers the processor 44 to retrieve the stored tag identification information from the memory unit 50. Upon receipt of the tag identification information, the tag identification information stored within the memory unit 50 is provided to the transmitter 56. The processor 44 then controls the transmitter 56 to transmit a signal 24 including the tag identification information to the antenna 44. Upon receipt of the signal 24 by the antenna 16, the display 22 is controlled to indicate that the toll has been paid and the account associated with the tag identification information is charged an amount equal to the toll. The first visual indicator 31 remains illuminated as long as the toll is paid and the account associated with the tag identification information is not overdrawn. Should the account be overdrawn, a signal is received back from the antenna indicative of such and the second visual indicator is illuminated. At this time the first visual indicator is turned off.

At times, a driver wishes to pass through a toll booth and pay the toll manually thereby avoiding the charge to the account. In this instant, the driver toggles the switch 34 into the first position. The switch 34 is connected between the power source 48 and the processor 44. When the switch 34 is activated, a voltage is removed from application to an input port of the processor 44. In response to the removal of the voltage, the processor applies a voltage to the second switch 52 causing the arm 54 of the second switch 52 to toggle into the open position. The second switch 52 is a normally closed switch thereby normally connecting the memory unit 50 to the processor 44. When the switch 34 is activated, a voltage is applied to the toggle arm 54 of the second switch 52 causing it to move into the open position thereby disconnecting the memory unit 50 and the processor 44. At this time the second visual indicator is illuminated to indicate that the toll payment device 30 is in the bypass state. The processor 44 is thus unable to retrieve the tag identification information from the memory unit 50. The tag identification information cannot be transmitted by the transmitter 56 back to the antenna 16 of the toll booth 10. The account associated with the toll payment device 30 will thus not be charged and the driver must pay the toll manually. The switch 34 remains activated for a predetermined period of time thereby disconnecting the memory unit 50 and the processor 44 for a time period able to allow the vehicle to pass through the toll booth. Thus, the vehicle may pass through the toll booth without activating the antenna to charge the account memory unit 50 and the transmitter 44. After the predetermined time period the switch 34 will return to the open position thereby preventing the application of voltage to the second switch 54 and returning the toll payment device 30 to its normal position and ready for passage through subsequent toll booths.

From the above description it can be seen that the toll payment device of the present invention is able to overcome the shortcomings of prior art devices by providing a toll payment device which is able to be positioned within a vehicle and hidden from sight so as not to obstruct the view of the driver or be readily visible to thieves. The toll payment device includes a switch positioned adjacent the driver's seat for deactivating the device to prevent automatic payment of a toll and is integrally connected within a vehicle such as under the hood of the vehicle, within a specially designed compartment or within the rear view mirror of the vehicle and thus cannot be stolen. Furthermore, the toll payment device of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claim is new and desired to be protected by Letters Patent is set forth in the appended claim:

1. A device for automatically paying a toll for a vehicle passing through a toll a) a transmitting device including:

i) a processor;

ii) a receiver for receiving a signal from an antenna at the toll booth and providing the signal to said processor;

iii) a memory unit for the storing identification information associated with said device; and iv) a transmitter connected to said processor for transmitting a signal including said stored identification information to the antenna upon receipt of the signal by the processor thereby allowing the antenna to charge an account associated with said device; and a switch for selective disconnecting said memory unit from said processor thereby preventing transmission of the identification information to he antenna and charging of the account associated with said device.

2. The toll payment device as recite in claim 1, wherein said switch includes a first switch positioned adjacent a driver seat of the vehicle and a second normally closed switch connected between said memory unit and said processor, wherein activation of said first switch toggles said second switch into an open position thereby disconnecting said memory unit and transmitter.

3. The toll payment device as recited in claim 2, wherein said switch is a three position switch, movable between a first position for disconnecting said processor from said memory unit, a second position connecting said processor and said memory unit and a third position causing said processor to cause said transmitter to transmit a signal to a toll payment tag, said signal causing the toll payment tag to transmit an information signal to said memory unit, the information signal including said identification information associated with said device.

4. The toll payment device as recited in claim 1, wherein said transmitting device is positioned under a hood of the vehicle.

5. The toll payment device as recited in claim 1, wherein said transmitting device is positioned within a compartment inside the vehicle.

6. The toll payment device as recited in claim 1, wherein said transmitting device is positioned within a rear view mirror of the vehicle.

7. The toll payment device as recited in claim 3, wherein said first switch is connected to a power source, said first switch being disconnected from said processor when in said first position, applying a first voltage to said processor when in said second position and applying a second voltage to said processor when in said third position.

8. The toll payment device as recited in claim 3, wherein said switch further includes a first visual indicator for indicating when said switch is in said third position.

9. The toll payment device as recited in claim 3, wherein said switch further includes a second visual indicator for indicating when said switch is in said first position.

10. The toll payment device as recited in claim 3, wherein said switch further includes a first visual indicator for indicating when said switch is in said second position and said information signal has been recorded in said memory unit and a second visual indicator for indicating when said switch is in said second position and said information signal has not been recorded in said memory unit.

11. A system for automatically paying a toll, said system comprising:

a) a toll booth including:

i) an antenna for transmitting a first signal and receiving a second signal in response thereto; and ii) a display for indicating receipt of said second signal; and b) a toll paying device including: p2 i) a transmitting device including a receiver for receiving said first signal from said antenna; a memory unit for storing identification information associated with said device; and a transmitter connected to both said receiver and said memory unit for transmitting said second signal including said stored identification information to said antenna upon receipt of said first signal whereby said antenna charges an account associated with said device and activates said display to indicate payment of the toll; and ii) a switch for selectively disconnecting said memory unit from said transmitter thereby preventing transmission of said second signal to said antenna and charging of the account associated with said device.

12. The system as recited in claim 11, wherein said switch includes a first switch positioned adjacent a driver seat of the vehicle and a second normally closed switch connected between said memory unit and said transmitter, wherein activation of said first switch toggles said second switch into an open position thereby disconnecting said memory unit and transmitter.

13. The system as recited in claim 12, wherein said first switch is a three position switch, movable between a first position for disconnecting said processor from said memory unit, a second position connecting said processor and said memory unit and a third position causing said processor to cause said transmitter to transmit a signal to a toll payment tag, said signal causing the toll payment tag to transmit an information signal to said memory unit, the information signal including said identification information associated with said device.

14. The system device as recited in claim 7, wherein said transmitting device is positioned under a hood of the vehicle.

15. The system as recited in claim 7, wherein said transmitting device is positioned within a compartment inside the vehicle.

16. The system as recited in claim 7, wherein said transmitting device is positioned within a rear view mirror of the vehicle.

17. The system as recited in claim 8, wherein said first switch is connected to a power source and upon activation, said first switch applies a voltage from the power source to said second switch causing said second switch to be toggled into the open position thereby disconnecting said memory unit and transmitter.

18. The system as recited in claim 13, wherein said first switch is connected to a power source, said first switch being disconnected from said processor when in said first position, applying a first voltage to said processor when in said second position and applying a second voltage to said processor when in said third position.

19. The system as recited in claim 13, wherein said switch further includes a first visual indicator for indicating when said third position.

20. The system as recited the claim 13,wherein said switch further includes a second visual indicator for indicating when said switch is said first position.

21. The system as recited in claim 13, wherein said switch further includes a first visual indicator for indicating when said switch is in said second position and said information signal has been recorded in said and memory unit and a second visual indicator for indication when said switch is in said second position and said information signal has not been recorded in said memory unit.

* * * * *